US009731213B2

(12) United States Patent
Laden et al.

(10) Patent No.: US 9,731,213 B2
(45) Date of Patent: Aug. 15, 2017

(54) BALLOONS ADAPTOR

(71) Applicant: TEMA TOYS & GAMES LTD., Binyamina (IL)

(72) Inventors: Ariel Laden, Givat Ada (IL); Uri Nir, Pardes Hanna-Karkur (IL)

( * ) Notice: Subject to any disclaimer, the term of this patent is extended or adjusted under 35 U.S.C. 154(b) by 0 days.

(21) Appl. No.: 15/028,003

(22) PCT Filed: Oct. 7, 2014

(86) PCT No.: PCT/IL2014/050877

§ 371 (c)(1),
(2) Date: Apr. 7, 2016

(87) PCT Pub. No.: WO2015/052709

PCT Pub. Date: Apr. 16, 2015

(65) Prior Publication Data

US 2016/0243454 A1 Aug. 25, 2016

Related U.S. Application Data

(60) Provisional application No. 61/888,394, filed on Oct. 8, 2013.

(51) Int. Cl.
*A63H 3/06* (2006.01)
*A63H 27/10* (2006.01)

(52) U.S. Cl.
CPC ..... *A63H 27/10* (2013.01); *A63H 2027/1033* (2013.01); *A63H 2027/1083* (2013.01)

(58) Field of Classification Search
CPC ..... A63H 27/10; A63H 2027/1033; A63H 2027/1083
USPC ..... 446/220, 222, 224; 137/223, 231, 233, 137/234; 251/349, 350, 353, 354
See application file for complete search history.

(56) References Cited

U.S. PATENT DOCUMENTS

| | | | | | |
|---|---|---|---|---|---|
| 1,315,955 | A | | 9/1919 | Gill | |
| 2,792,669 | A | * | 5/1957 | Jackson | A63H 27/10 251/353 |
| 2,924,041 | A | * | 2/1960 | Jackson | A63H 27/10 251/353 |
| 3,616,569 | A | * | 11/1971 | Litt | A63H 27/10 446/220 |
| 4,034,501 | A | * | 7/1977 | Zeyra | A63H 27/10 446/224 |
| 4,167,204 | A | * | 9/1979 | Zeyra | A63B 41/12 137/231 |

(Continued)

FOREIGN PATENT DOCUMENTS

FR 1034889 8/1953

*Primary Examiner* — Kurt Fernstrom
(74) *Attorney, Agent, or Firm* — Mark David Torche; Patwrite LLC

(57) ABSTRACT

A balloon adaptor formed from a single piece body for receiving therein a balloon flange. The balloon adaptor has a one-way valve that is located between an inflating opening and a balloon insertion opening. The balloon insertion opening has a forwardly diverging conical surface and ends, in a rearward portion thereof, with a sharp shoulder. The balloon flange abuts against a shoulder abutment surface that holds the balloon attached to the balloon adaptor during inflation of the balloon. The present invention also discloses a balloon release mechanism for easily releasing the inflated balloon from the balloon adaptor.

15 Claims, 12 Drawing Sheets

(56) References Cited

U.S. PATENT DOCUMENTS

| | | | | | |
|---|---|---|---|---|---|
| 4,701,148 | A * | 10/1987 | Cotey | A63H 27/10 | 137/223 |
| 4,911,379 | A * | 3/1990 | Kopelman | A63H 27/10 | 116/210 |
| 4,911,674 | A * | 3/1990 | Cole | A63H 27/10 | 137/853 |
| 5,121,595 | A * | 6/1992 | Shore | A63H 27/10 | 141/173 |
| 5,245,991 | A * | 9/1993 | Kawaguchi | A63B 23/18 | 128/200.24 |
| 5,496,203 | A * | 3/1996 | Murray | A63H 27/10 | 446/221 |
| 5,588,896 | A | 12/1996 | Goodman | | |
| 6,471,621 | B2 * | 10/2002 | Horstel | A63B 23/032 | 128/860 |
| 6,790,120 | B1 * | 9/2004 | Murray | A63H 27/10 | 446/220 |
| 6,814,644 | B2 * | 11/2004 | Nelson | A63H 27/10 | 446/221 |
| 7,850,328 | B2 * | 12/2010 | Carito | A63H 27/10 | 362/184 |
| 8,512,091 | B2 * | 8/2013 | Nelson | A63H 27/10 | 446/220 |
| 2008/0254710 | A1 * | 10/2008 | Nelson | B63C 9/24 | 446/224 |

* cited by examiner

BALLOONS ADAPTOR

FIELD OF THE INVENTION

The present invention relates to the field of adaptors for inflating balloons, and more particularly to the field of adaptors for inflating balloons and releasing the inflated balloons therefrom.

BACKGROUND OF THE INVENTION

Balloons are known and used for many years in a large variety of uses and applications. For example, balloons may be used for decoration of dinner tables, wedding cars, entrance to houses or gardens, ceilings, event halls, swimming pools, and the like.

Balloons may be used for fun and for games. Even though balloons are typically carried and played by children, also adults used to use balloons for social games activities.

The balloons may be inflated with air or with a gas that is lighter than the air. When a balloon is inflated with air, the inflated balloon will be heavier than the air and, therefore, it will lie in its place or be hanged from a higher place. When a balloon is inflated with a gas that is lighter than the air, e.g., helium, the inflated balloon will tend to fly upwards. This effect is used in decoration, or, when walking with an inflated balloon that is tied with a string. Furthermore, the upwardly flying of a balloon may also be used as a show, e.g., when releasing inflated balloons in a public event.

The balloons may be inflated in various ways. When a small quantity is to be inflated, the balloons are typically inflated manually, i.e., holding the balloon neck inside the mouth, inhaling air into the lungs, and forcibly excelling the air into the balloon while overcoming its initial expansion tension. When the balloon reaches its desired size, the inflating is stopped and the balloon is removed from the mouth with two fingers while keeping the balloon's neck pressed tight in order to prevent the air from escaping from the balloon. Then, the balloon's neck is tied up, typically, by stretching it and self tightening it.

The inflating of a balloon by the mouth as described above suffers from various disadvantages. First, many times it is very difficult or nearly impossible to overcome the initial expansion tension of the balloon. It is a very difficult and disappointing task for a child at the ages of 6-10 years, and, may be a totally impossible task to be carried out by a younger child. Second, the inflated balloon exerts back pressure on the lungs of the inflating child/adult, a fact that may cause damage, especially to children. Furthermore, the inhalation of the carbon-dioxide ($CO_2$) from the balloon may cause fainting. Third, the inflated balloon has to be held tightly with the lips in order to prevent any air escape. In this position, the entire balloon or a portion thereof may be partially swallowed and stuck in the trachea (the windpipe). This may cause asphyxia, i.e., suffocation, due to lack of oxygen. Fourth, the inflating action should take place relatively fast in order not to get tired of holding the inflated balloon while inflating and prior to tying. This action may be difficult to coordinate between the mouth and the hands. Fifth, when releasing the balloon from the mouth by means of one hand it leaves only one hand for handling the tying of the inflated balloon, a task that may be very difficult to accomplish.

Other methods of inflating balloons are through pumps, whether manual or electrical. In those cases, the balloon neck has to be stretched on an inflating nozzle of a pump, then, the pump is operated, either manually by hand or foot, or, electrically. In these cases, at the end of the inflation both hands are free to perform the tying action. However, in many cases, it is necessary to tightly hold the balloon on the inflating nozzle in order to prevent air leak and in order to prevent the balloon from disengaging the nozzle. It is clear that in this case neither of the hands are free for tying the balloon.

A disadvantage of those systems is that they are relatively expensive, and cannot be operated by small children. Furthermore, when mounting and stretching the balloon's neck over the inflating nozzle, an action that may be difficult to children, extreme care should be taken not to tear the balloon.

In a case where the balloon is inflated with a light gas like helium, the balloon's neck is stretched over a nozzle that is connected to an outlet valve of a compressed gas cylinder. This method suffers from the disadvantages described in the former paragraph, and, furthermore, from the precautions that should be taken care when handling compressed gas cylinders.

There are various assemblies known in the art for inflating balloons. FR1034889 discloses a tip grip for easy inflating air balloons for children. FIG. 1 of '889 describes a tip gripper that is formed by a length of tube 5, preferably of cardboard or similar material and with a short piece of rubber tubing 6 that fits tightly on the end of the nozzle, this tube piece rubber being flattened so that it takes the position shown in FIG. 1, when one of its ends is fitted onto the endpiece, the other end remaining flat.

A ball 7 of the hub 5 is mounted in its interfitting collar rubber tube piece 6 until the flange 8 provided at the outer end of said neck is engaged on the tip end of the rubber tube mounted on the mouthpiece.

The pressure in the balloon tends to expel it from the end of the nozzle 6 but closely greenhouse tube tip and the neck of the flusk in turn, exerts a good hold by friction on the rubber tube. The bead 8 of the engaged end of the collar against the end of the tube in turns helps to prevent the ball from escaping from the nozzle.

FIG. 2 of '889 describes the ball 10 of the balloon that is held in position on the tip 11 by a rigid sleeve 12 which is threaded into the neck 13 of the flask and part of the collar is folded back over the sleeve 12 so that the bead 14 is reduced to above the sleeve. The sleeve is then pushed, in turn, in the end of the nozzle 11 in which it fits tightly, which secures the balloon.

A disadvantage of the '889 patent is that it utilizes two devices for holding the balloon, namely, a tube and a sleeve. Furthermore, the method of mounting the balloon on the tip and the necessity to fold it backwards, is relatively complicated to do, and it may be impossible to be carried out by small children.

U.S. Pat. No. 1,315,955 discloses a valve for inflating bodies. The convex, thin and flexible part 7 is a part of a disc 4. The balloon flange is mounted on the groove 6 and remains attached therein. Afterwards, a piece of the convex part 7 is cut such that a portion 8 thereof, between points a and b remains attached to the disc, and the cut part utilizes as a one-way valve during the inflation of the balloon.

It is the object of the present invention to provide a balloons inflator that significantly reduces or overcomes the aforementioned disadvantages.

It is a further object of the present invention to provide a balloons inflator that is easy to use.

It is still a further object of the present invention to provide a balloons inflator that can be operated by small children.

It is still yet a further object of the present invention to provide a balloons inflator that prevents air escaping from the inflated balloon.

It is also a further object of the present invention to provide a balloons inflator that leaves both hands free.

It is another object of the present invention to provide a balloons inflator that can be used as a toy in a variety of applications.

It is still yet another object of the present invention to provide a balloons inflator that enables releasing the inflated balloon manually or mechanically.

It is still further another object of the present invention to provide a balloons inflator that can easily release the inflated balloon.

It is also another object of the present invention to provide a balloon adaptor that is formed from a single piece body.

SUMMARY OF THE INVENTION

In accordance with the present invention there is provided a balloon adaptor for receiving therein a balloon flange of a balloon, the balloon adaptor is formed from a single piece body and comprises:

an inflating opening, and a balloon insertion opening.

Typically, the balloon insertion opening comprises a substantially cylindrical opening neck, and, and outwardly diverging chamfer extending forwardly from the opening neck.

If desired, the balloon insertion opening comprises a forwardly diverging conical surface.

Preferably, the balloon insertion opening comprises a rear shoulder that is formed between an opening neck of the balloon insertion opening and a shoulder abutment surface that extends radially outwardly from the rear shoulder.

Further preferably, the rear shoulder is sharp and not greater that 90 degrees.

In some embodiments, the balloon adaptor comprises a one-way valve that is located between the inflating opening and the balloon insertion opening.

If desired, the one-way valve is a leaf valve.

Preferably, the rear shoulder has a neck diameter (D3), the balloon flange has a flange inner diameter (D1) and a flange outer diameter (D2), and wherein the flange inner diameter substantially equals the neck diameter, and the flange outer diameter is substantially larger that the neck diameter.

Advantageously, in an inserted position of the balloon flange into the balloon insertion opening, the balloon is attached to the balloon adaptor and cannot be easily pulled away therefrom.

When the balloon is to be inflated by a mouth of a user, the inflation opening is adapted to be held by the mouth of a user.

When the balloon is to be inflated by a mechanical pump, electrical pump, or a pressure vessel, the inflating opening is adapted to be connected to an inflating device.

Easily, upon inflating the balloon to the desired size and forming an inflated balloon neck, the inflated balloon is released from the balloon adaptor by squeezing the inflated balloon neck in a direction that is substantially perpendicular to a longitudinal dimension of the balloon neck.

If desired, the balloon adaptor further comprises a balloon releasing mechanism for releasing the inflated balloon from the balloon adaptor.

Typically, the balloon releasing mechanism comprises at least one activating lever that is pivoted on a pivot, the at least one activating lever comprises an operating handle and a releasing lever.

If desired, in an inflated position of the balloon and in an un-operated position of the activating lever the releasing lever gently abuts against a front surface of the balloon adaptor and against the inflated balloon neck.

Advantageously, in a releasing stage of the inflated balloon the operating handle is moved in a releasing direction and a front end of the releasing lever presses against the balloon neck in a sideways direction.

Further advantageously, the front end of the releasing lever presses against the balloon neck also in a forward direction thus applying a combined sideways and forward motion on the balloon neck.

Practically, in most of the embodiments, the releasing of the inflated balloon from the balloon adaptor is carried out in one of the following methods: (1) squeezing sideways the balloon neck and pushing it forwardly, (2) opening or increasing a balloon insertion opening, (3) forming a forward portion of the balloon adaptor from a flexible material that may be squeezed to release the balloon, (4) self releasing the balloon at the end of inflation due to disappearing of a balloon neck and pressing by the balloon body against a forward portion of the balloon adaptor.

In some embodiments, a front end of the adaptor is modified to a combi adaptor and replaced with interchangeable size adaptor heads, each size adaptor head is adapted to hold a different size of a balloon flange.

Typically, a forward portion of the combi adaptor comprises a head supporting protrusion that is adapted to fit into a corresponding protrusion receiving recess in a rear portion of each of the size adaptor heads.

If desired, each size adaptor head is fitted on the combi adaptor by one of the following methods: (1) tight fitting by direct pressure, (2) snap-on fitting, (3) threading, (4) bayonet engagement.

Further in accordance with the present invention there is provided a process for inflating a balloon, having a balloon flange and a balloon neck, by a balloon adaptor and releasing the inflated balloon from the balloon adaptor, the process comprises the steps of:

a. Providing a balloon adaptor that is formed from a single piece and comprising: an inflating opening, and, a balloon insertion opening.
b. Inserting the balloon flange into the balloon insertion opening such that the balloon is self attached to the balloon adaptor and cannot be easily pulled away therefrom.
c. Inflating the balloon, by a mouth of a user or mechanically, through the inflating opening.
d. Releasing the inflated balloon by squeezing the balloon neck in a direction that is substantially perpendicular to a longitudinal dimension of the balloon neck.

If desired, the process further comprising the step of:

e. Squeezing the balloon neck in a forward direction, thus applying a combined sideways and forward motion of the balloon neck.

Further if desired, the process further comprising the steps of:

f. Providing the balloon adaptor with a balloon releasing mechanism, the balloon releasing mechanism comprising at least one activating lever that is pivoted and comprising an operating handle and a releasing lever.
g. In an inflated position of the balloon and in an un-operated position of the activating lever the releasing lever gently abuts against a front surface of the balloon adaptor and against the inflated balloon neck.

h. In a releasing stage of the inflated balloon the operating handle is moved in a releasing direction and a front end of the releasing lever presses against the balloon neck in a sideways direction.

i. The front end of the releasing lever presses against the balloon neck in a forward direction thus applying a combined sideways and forward motion of the balloon neck.

BRIEF DESCRIPTION OF THE DRAWINGS

For a better understanding of the present invention and to show how the same may be carried out in practice, reference will now be made to the accompanying drawings, in which.

DESCRIPTION OF PREFERRED EMBODIMENTS

Figure 1:
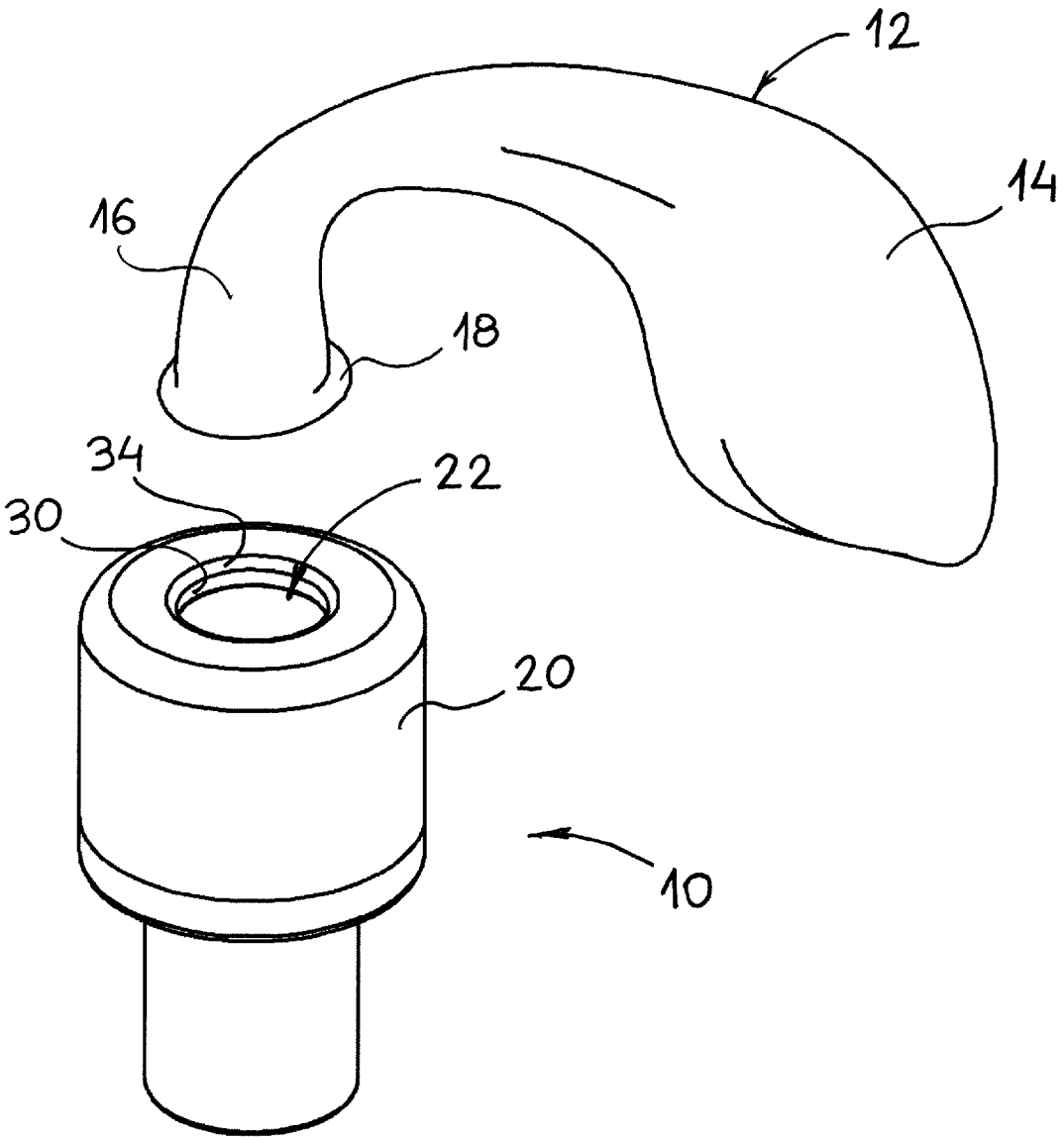
FIG. 1 is a perspective view of a balloon and a balloon adaptor according to the present invention.
Figure 2:
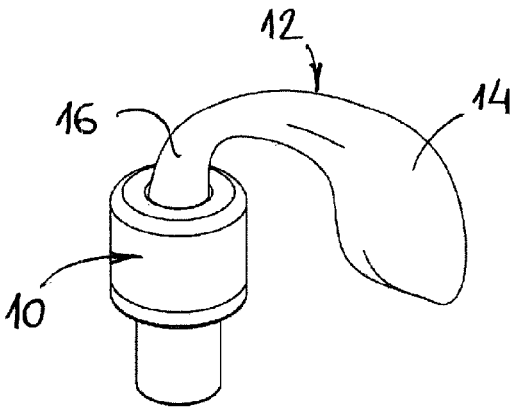
FIG. 2 is a perspective view of the balloon and the balloon adaptor of FIG. 1 with the balloon inserted into the balloon adaptor.
Figure 3:
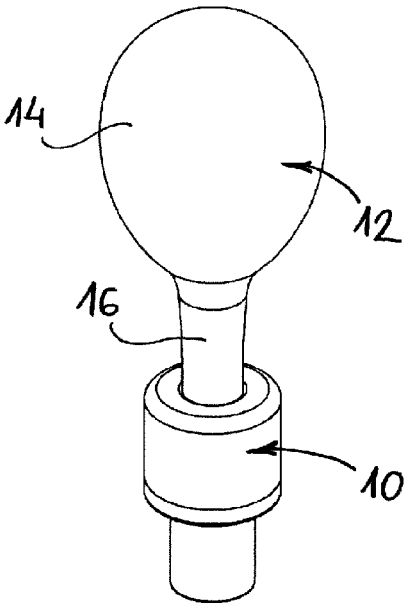
FIG. 3 is a perspective view of the balloon and the balloon adaptor of FIG. 1 in a first inflating position.
Figure 4:
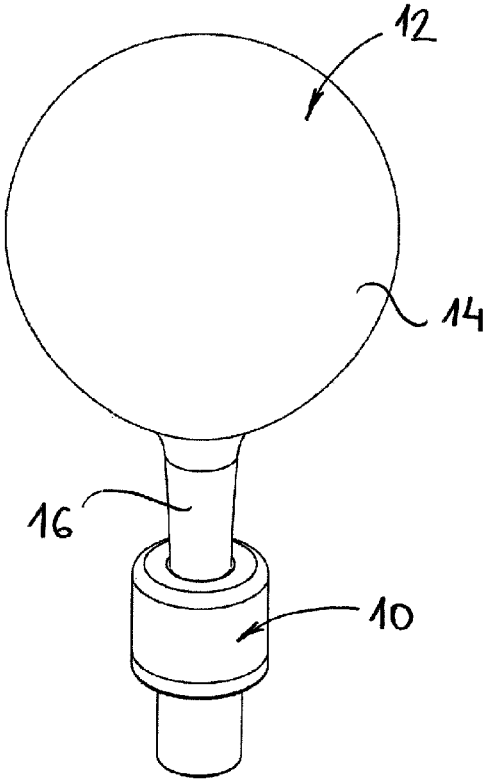
FIG. 4 is a perspective view of the balloon and the balloon adaptor of FIG. 1 in a final inflating position.
Figure 5:
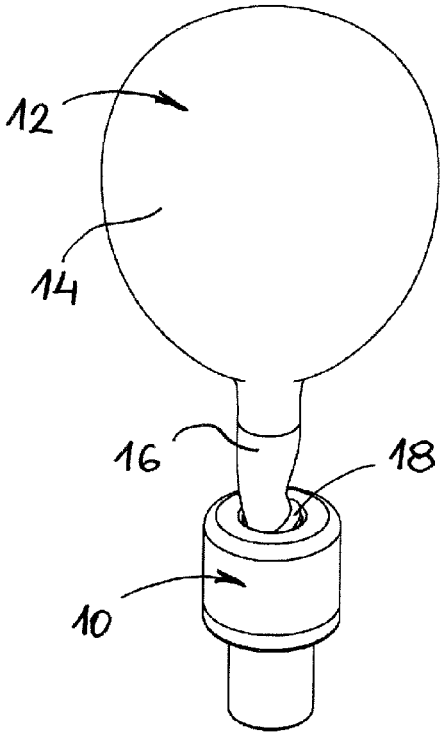
FIG. 5 is a perspective view of the balloon and the balloon adaptor of FIG. 1 during a balloon releasing stage.

Attention is first drawn to FIGS. 1 to 12 that show a balloon adaptor 10 according to the present invention and a balloon 12. Typically, each balloon 12 comprises three portions; (1) a balloon body 14, (2) a balloon neck 16, and, (3) a balloon flange 18. In an un-squeezed position of the balloon flange 18 it has a round ring shape having a flange inner diameter D1 and a flange outer diameter D2.

The balloon adaptor 10 has a generally cylindrical body 20 having a balloon insertion opening 22 in a forward portion 24 thereof, and, an inflating opening 26 in a rearward portion 28 thereof.

It should be noted that directional terms appearing throughout the specification and claims, e.g. "forward", "rear", "upper", "lower" etc., are used as terms of convenience to distinguish the location of various surfaces relative to each other. These terms are defined with reference to the figures, however, they are used for illustrative purposes only, and are not intended to limit the scope of the appended claims.

The inflating opening 26 may have various forms and sizes to suit the mouth of a user, whether it is an adult or a child, or, to be connected to an inflating device. The inflating device may be, for example, a mechanical pump, operated by foot or hand, an electrical pump, operated by mains voltage or by batteries, or, a pressure vessel, fixed or mobile, that is filled with a pressurized gas, like pressurized air or helium, for inflating balloons, as will be later described.

The balloon insertion opening 22 comprises an opening neck 30 which is cylindrical and having a neck diameter D3. The opening neck 30 extends from a rear shoulder 32, in a rearward portion thereof, to a chamfer 34, in a forward portion thereof. The chamfer 34 diverges outwardly and forwardly from the opening neck 30. The purpose of the chamfer 34 is to enable easy insertion of the balloon flange 18 into the balloon insertion opening 22 as will be later described.

The rear shoulder 32 is formed from the opening neck 30 and from a shoulder abutment surface 36 that extends radially outwardly from the rear shoulder 32 and is perpendicular to the opening neck 30. Thus, the rear shoulder 32 is relatively sharp, i.e., having an angle not greater than 90 degrees, for better holding the balloon flange 18 as will be later described.

The balloon adaptor 10 is provided with a one-way valve 38 (a non-return valve) that is located between the balloon insertion opening 22 and the inflating opening 26. According to a specific embodiment of the present invention, the one-way valve is a leaf valve.

Figure 6:
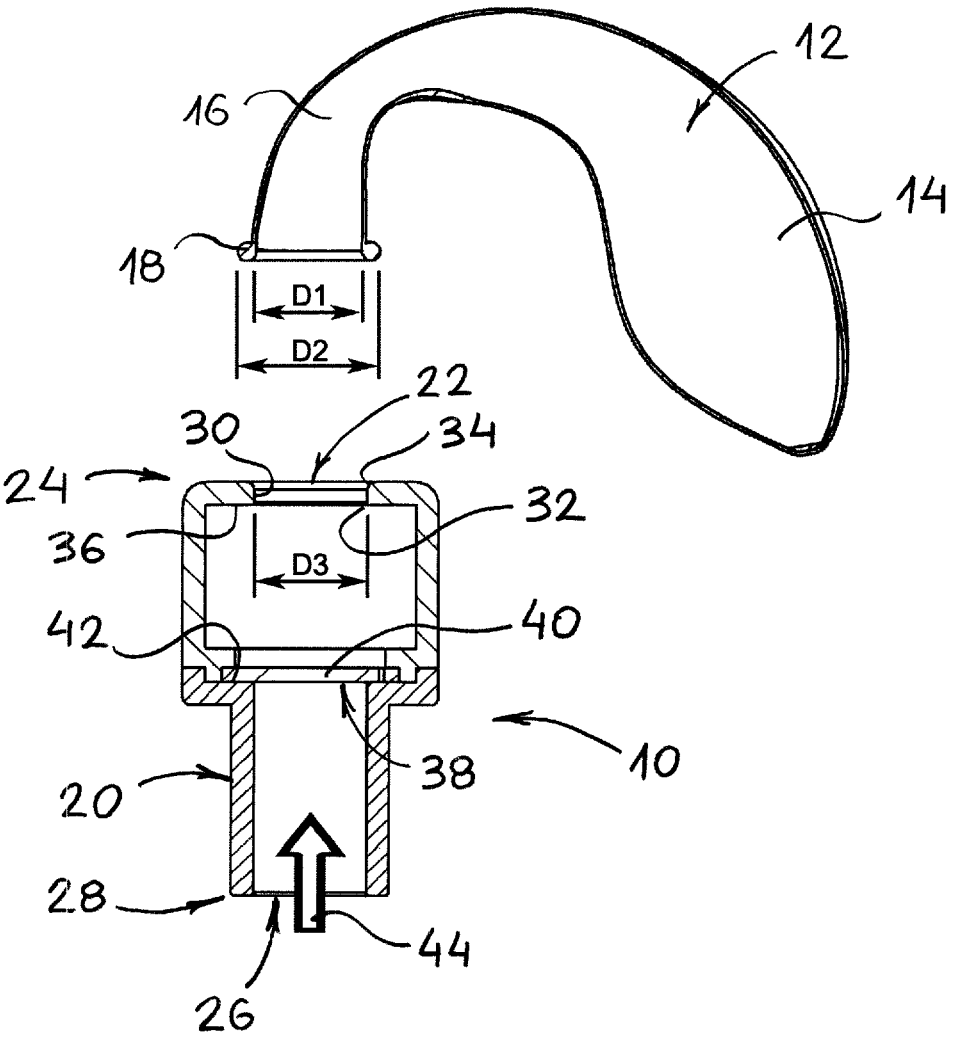
FIG. 6 is a side cross-sectional view of the balloon and the balloon adaptor of FIG. 1 prior to inserting the balloon into the balloon adaptor.

The leaf valve comprises a leaf 40 that is hinged with respect to a valve base 42. In FIG. 6, the leaf 40 is shown in a rest position. When air is blown through the inflating opening 26 in a forward direction as shown by a forward direction arrow 44, the leaf 40 tends to partially lift from the valve base 42 thus enabling the air to pass therethrough toward the balloon insertion opening 22. When the air blowing is ceased, the leaf 40 returns to its resting position, i.e., lying against the valve base 42.

Figure 7:
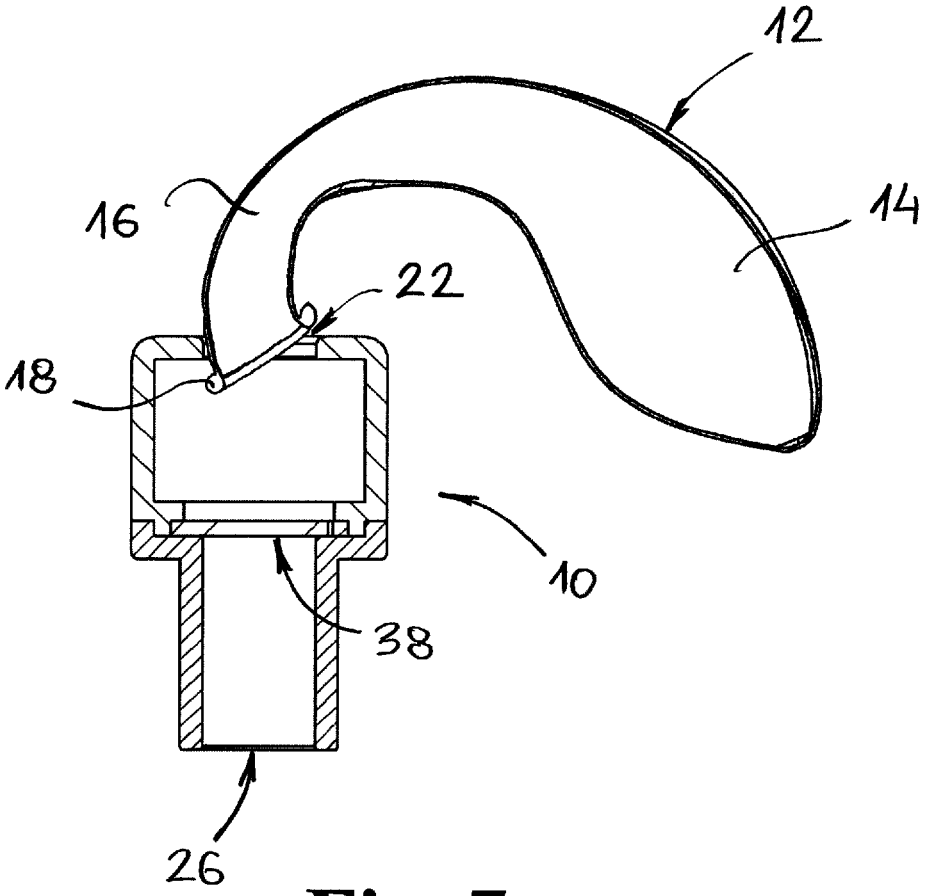
FIG. 7 is a side cross-sectional view of the balloon and the balloon adaptor of FIG. 6 during insertion of the balloon's flange into the balloon adaptor.

In order to attach the balloon 12 to the balloon adaptor 10, the balloon flange 18 is pushed into the balloon insertion opening 22 as shown in FIG. 7. This action can be done by slightly squeezing the balloon flange 18 and inserting it as a whole into the balloon insertion opening 22, or, by just pushing the balloon flange 18 into the balloon insertion opening 22 until the entire balloon flange 18 passes through the opening neck 30. The insertion of the balloon flange 18 into the balloon insertion opening 22 is very easy to perform and field tests shown that even children of two years old could perform this task successfully.

Figure 8:
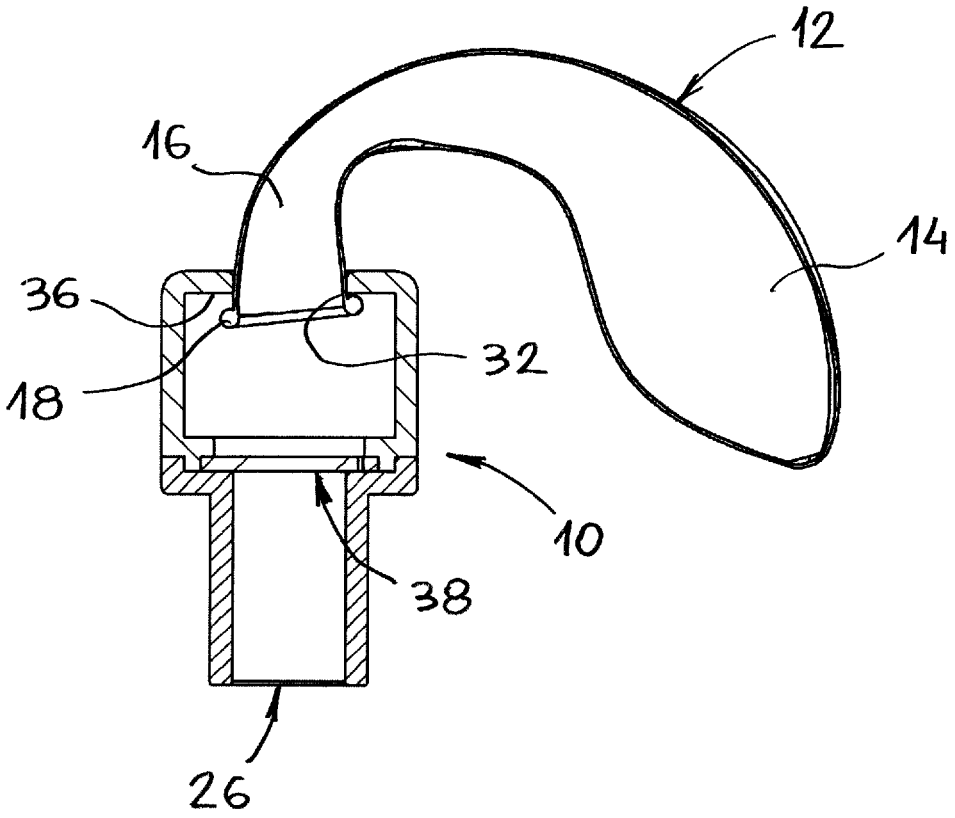
FIG. 8 is a side cross-sectional view of the balloon and the balloon adaptor of FIG. 6 when the balloon's flange is entirely within the balloon adaptor.

The chamfer 34 formed at the front end of the balloon insertion opening 22 enables easy leading of the balloon flange 18 through the opening neck 30. FIG. 8 shows the relative position between the balloon 12 and the balloon adaptor 10 when the balloon flange 18 passed in its entirety through the opening neck 30. In this position, the balloon flange 18 returns to its un-squeezed position, i.e., to a round ring shape.

Figure 9:
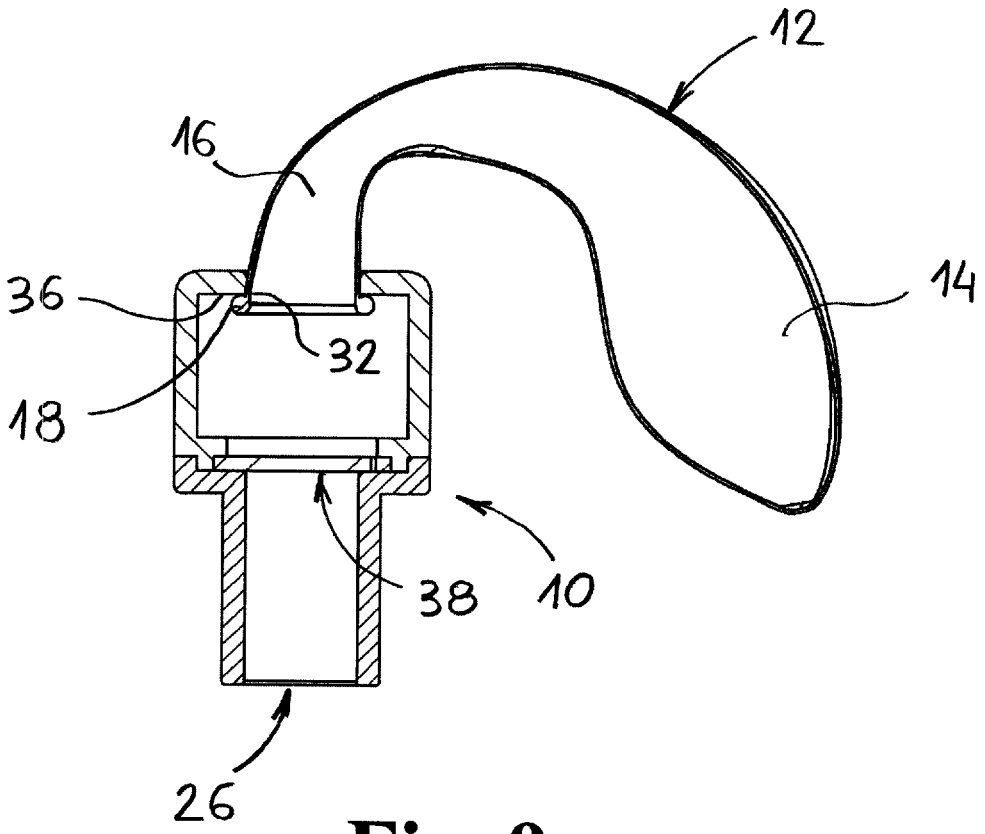
FIG. 9 is a side cross-sectional view of the balloon and the balloon adaptor of FIG. 6 when the balloon's flange abuts the balloon adaptor.

The flange inner diameter D1 generally equals to the neck diameter D3. However, the flange outer diameter D2 is substantially larger than the neck diameter D3. Thus, as shown in FIG. 9, after the balloon flange 18 had been inserted through the opening neck 30 and returned to its round shape, the balloon flange 18 abuts against the shoulder abutment surface 36 in a case where the balloon body 14 is slightly pulled thus enabling beginning of inflating when the balloon flange 18 abuts against the shoulder abutment surface 36.

In a case where the balloon flange 18 had been intentionally thoroughly inserted into the balloon insertion opening 22, i.e., together with the balloon neck 16 and even a portion of the balloon body 14, in this case when beginning the inflation, a portion of the incoming air will enter into the balloon 12 and a portion of the air will escape between the balloon neck 16 and the opening neck 30. This will be remedied soon after the balloon 12 starts to be slightly inflated, when the balloon flange 18 will get into abutment against the shoulder abutment surface 36.

Since the flange outer diameter D2 is larger than the neck diameter D3, the balloon 12 remains in its position and cannot be easily or unintentionally pulled out of the balloon adaptor 10. The shape of the sharp rear shoulder 32 adds to the stability of the abutment of the balloon flange 18 against the shoulder abutment surface 36.

Figure 10:
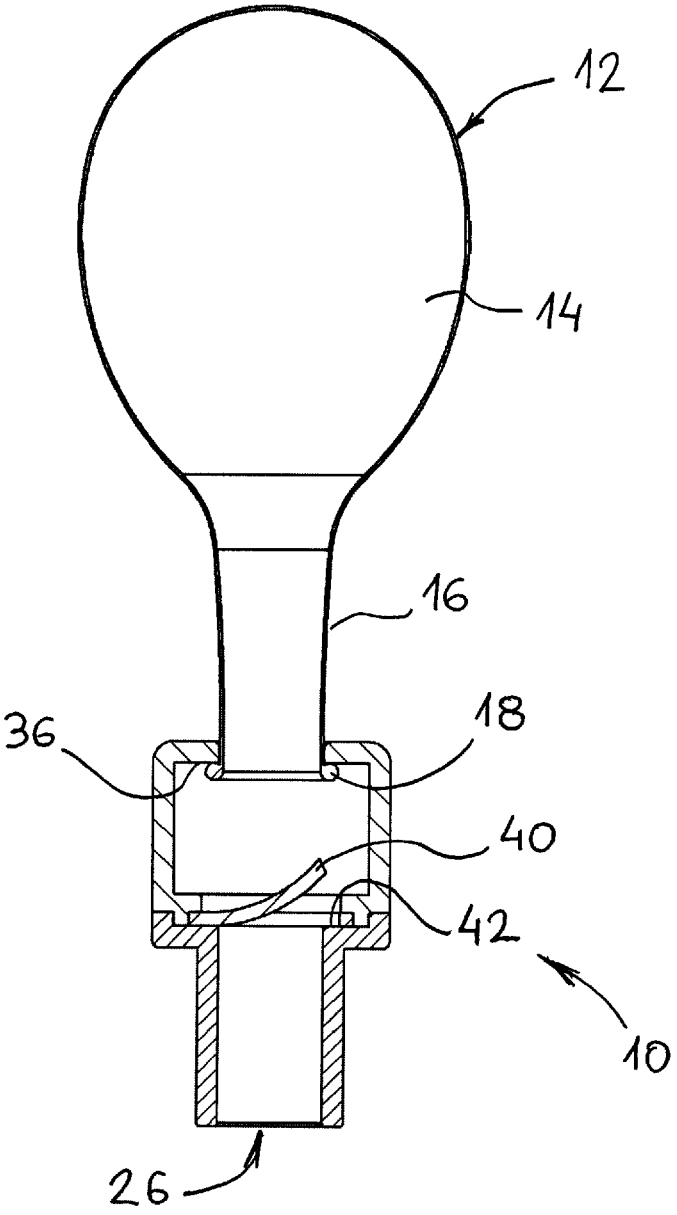
FIG. 10 is a side cross-sectional view of the balloon and the balloon adaptor during inflation stage.

Now, the balloon 12 is safely attached to the balloon adaptor 10 and ready to be inflated. FIG. 10 shows the balloon 12 and the balloon adaptor 10 during inflation stage. When air is blown through the inflating opening 26 in the direction of a forward direction arrow 44, beyond a given pressure threshold value, the pressure of the air tends to partially lift the leaf 40 from the valve base 42 and the air may pass through the one-way valve 38 towards the balloon 12. As the balloon body 14 and the balloon neck 16 are filled with air, they increase their volume, thus, the balloon neck 16 presses against the opening neck 30 and adds to the sealing of the balloon neck 16 against the opening neck 30 and of the balloon flange 18 against the shoulder abutment surface 36. In this manner it is guaranteed that during the inflation of the balloon 12 no air will escape between the balloon 12 and the balloon insertion opening 22.

Figure 11:
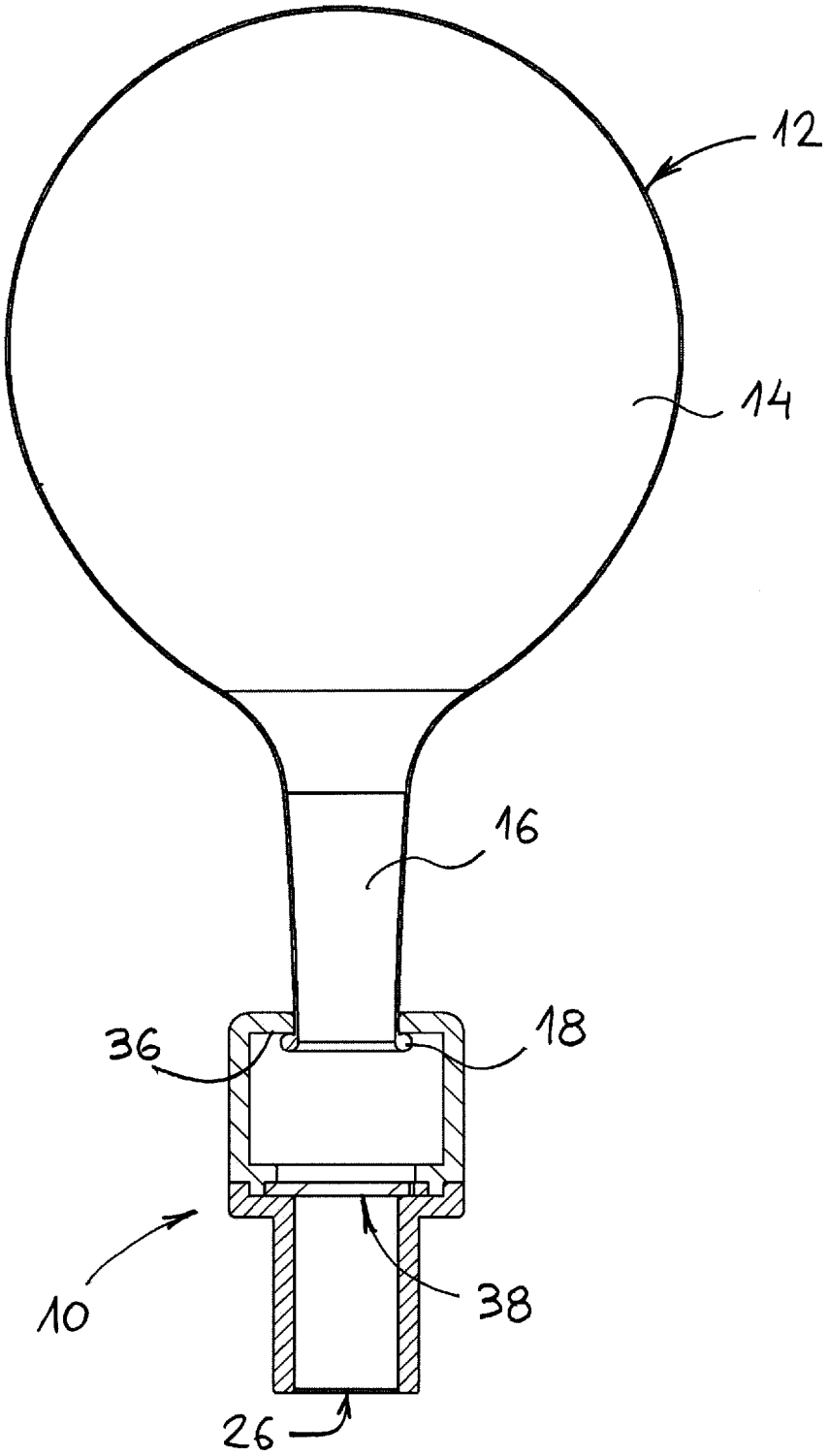
FIG. 11 is a side cross-sectional view of the balloon and the balloon adaptor during inhalation, pause or rest.

FIG. 11 shows the balloon 12 and the balloon adaptor 10 during inhalation or during a pause or rest of the blowing action. In this position, when the person inflating the balloon stops blowing into the inflating opening 26 and inhales air for the next blow, the air pressure within the balloon 12 forces the leaf 40 back against the valve base 42, the one-way valve 38 is closed, and no air can flow out of the balloon 12. In the next blow, the process described with respect to FIG. 10 is repeated.

In a case where a mechanical pump or other devices are used in order to inflate the balloon 12, instead of manually inflating by the power of the lungs of the person inflating the balloon, the process is similar to the described above. Namely, when the mechanical pump (not shown in the figures) is pressing air during a power stroke, the air is blown through the inflating opening 26, lifting the leaf 40 from the valve base 42, and entering into the balloon 12. When the mechanical pump is "winded" or "reloaded" to the next power stroke, as with hand or foot operated pumps, at this stage the air pressure within the balloon 12 closes the leaf 40 against the valve base 42 and no air can flow out of the balloon 12. This process is repeated until the balloon 12 gets to its desired inflated size.

After the balloon 12 got to its desired size, it may be removed from the balloon adaptor 10. The balloon neck 16 may be tied when the balloon 12 is still attached to the balloon adaptor 10, or, after it is removed therefrom.

Figure 12:
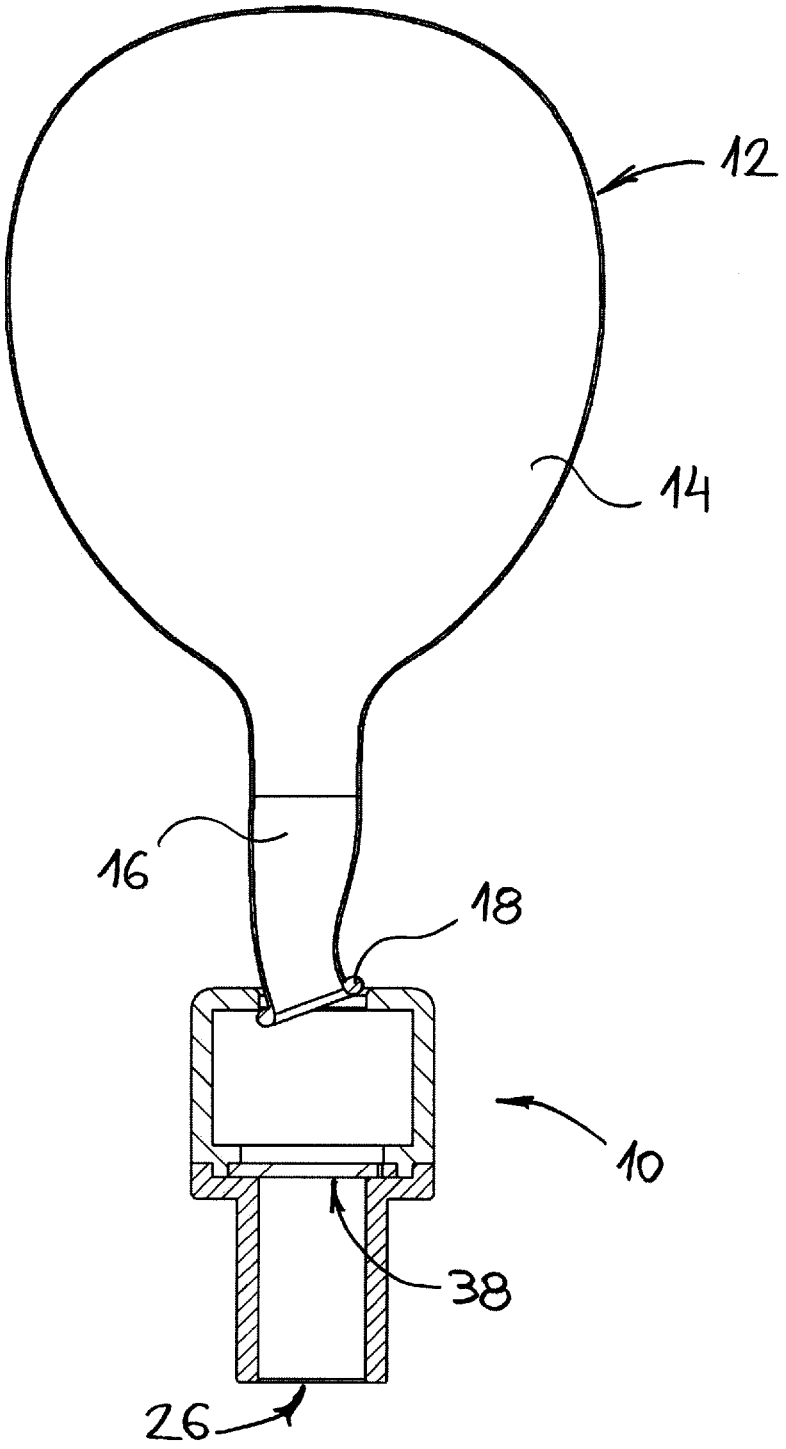
FIG. 12 is a side cross-sectional view of the balloon and the balloon adaptor while beginning releasing the inflated balloon from the balloon adaptor.

FIG. 12 shows the beginning of removing the inflated balloon 12 from the balloon adaptor 10. Thus, in order to remove the inflated balloon 12 from the balloon adaptor 10, the balloon neck 16 is slightly squeezed, adjacent the balloon flange 18, in a squeezing direction 46 that is generally perpendicular to a longitudinal dimension of the balloon neck 16.

Said squeezing causes two simultaneous outcomes. First, a portion of the balloon flange 18 is moved from the shoulder abutment surface 36 and removed out of the balloon insertion opening 22. Second, the first outcome creates a free air passage from the inflated balloon 12 to the atmosphere. This causes a burst of air out of the balloon 12, a fact that further assists in removing the entire balloon flange 18 out of the balloon insertion opening 22 and distances the balloon 12 away from the forward portion 24 of the balloon adaptor 10.

Another way of releasing the balloon 12 from the balloon insertion opening 22 may be by pressing, moving, pushing, slamming, kicking or hitting the balloon body 14 instead of the balloon neck 16. Eventually, it will cause the balloon body 14 to affect the balloon neck 16 in a similar manner, as if pushing directly on the balloon neck 16, until the balloon flange 18 is released and the entire balloon 12 is released. This effect may be used in various toys applications, whereas a child is supposed to release a balloon by one of the methods described in the beginning of this paragraph.

Figure 13:
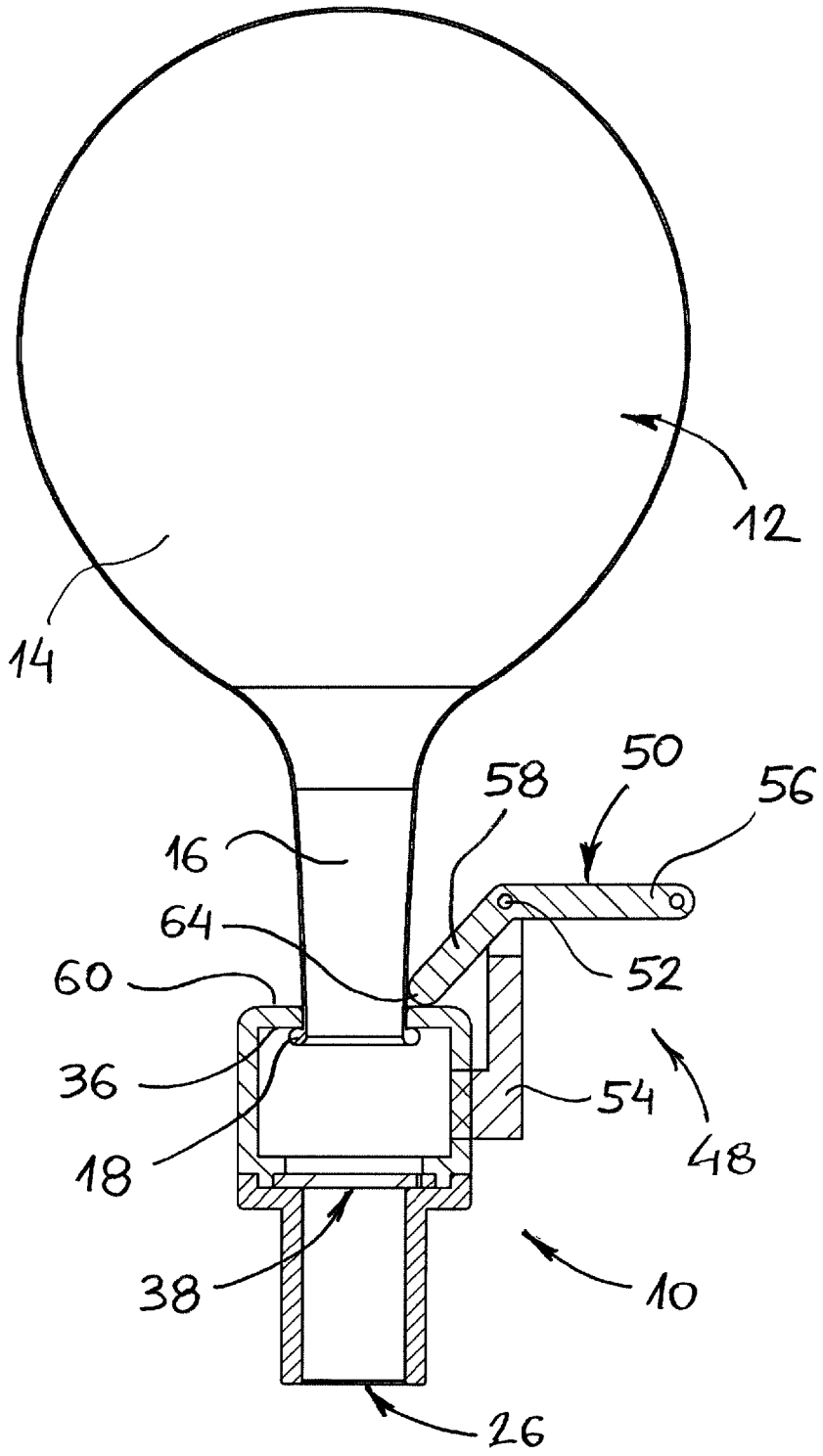
FIG. 13 is a side cross-sectional view of the balloon and the balloon adaptor with a balloon releasing mechanism in a first releasing stage.
Figure 14:
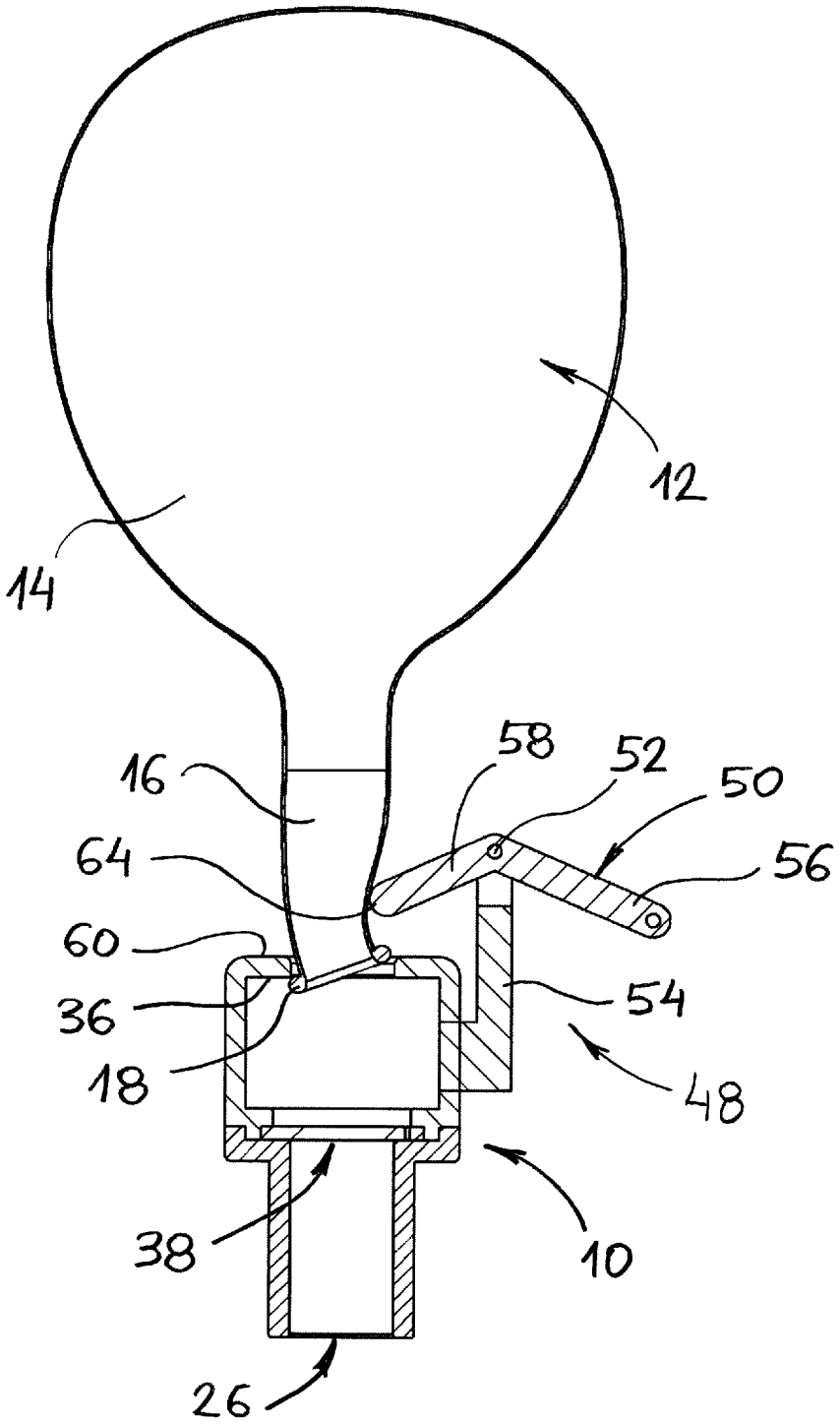
FIG. 14 is a side cross-sectional view of the balloon and the balloon adaptor of FIG. 13 with the balloon releasing mechanism in a second releasing stage.

A balloon releasing mechanism 48 for releasing the balloon 12 out of the balloon adaptor 10 is shown in FIGS. 13 and 14. The balloon releasing mechanism 48 comprises an activating lever 50 that is pivoted on a pivot 52 of a supporting bracket 54. The activating lever 50 comprises an operating handle 56, that is remote from the inflated balloon 12, and, a releasing lever 58, adjacent the inflated balloon 12. In an un-operated position of the activating lever 50, which is a first releasing stage as shown in FIG. 13, the releasing lever 58 gently abuts against a front surface 60 of the balloon adaptor 10 and against the inflated balloon neck 16.

When it is desired to release the balloon 12 from the balloon adaptor 10, as shown in FIG. 14 which is a second releasing stage, the operating handle 56 is moved in a releasing direction 62, which in FIG. 14 is a clockwise direction. Since the activating lever 50 rotates around the pivot 52, a lever front end 64 of the releasing lever 58 presses against the balloon neck 16 in a combined sideways and forward motion, thus releasing the balloon flange 18 out of the balloon insertion opening 22 in a similar manner as was described with respect to FIG. 12, and simultaneously pushing the balloon 12 forwardly due to the friction between the lever front end 64 and the outer surface of the inflated balloon which is typically made of latex.

Typically, there are two major types of balloons that are widely used in the market. A first type of balloon is the common "ball" balloon that is shown in the figures. A second type of balloon is a type known as a "modeling balloon", that, when inflated, has a form of a long sausage, and practically has no balloon neck. The balloon flange of the modeling balloon is much smaller than the balloon flange of the ball-type balloon.

Figure 15:
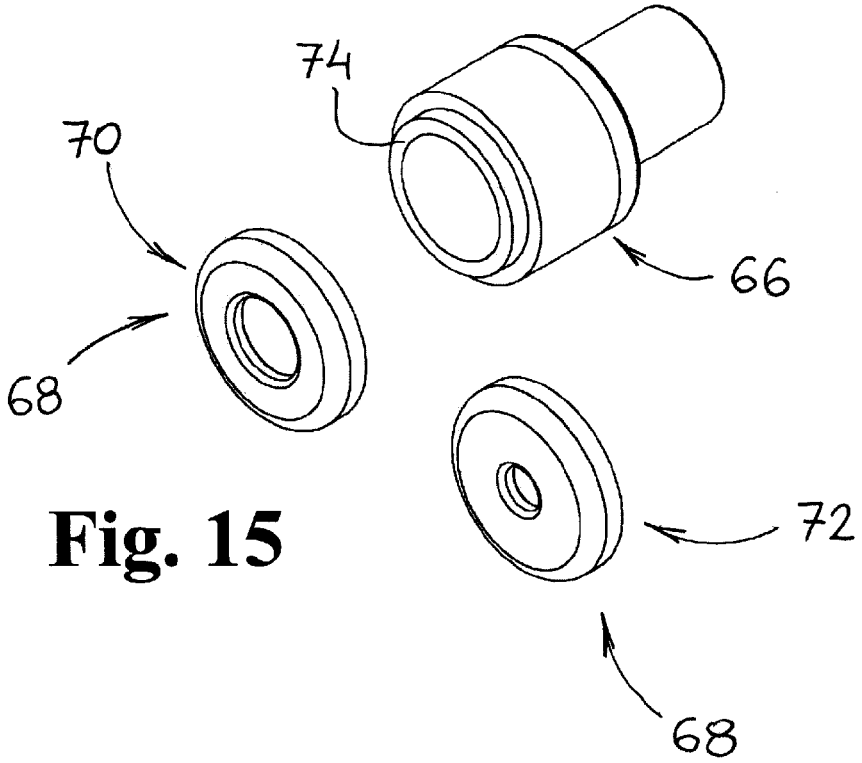
FIG. 15 is a perspective view of a combi adaptor and size adaptor heads according to the present invention.
Figure 16:
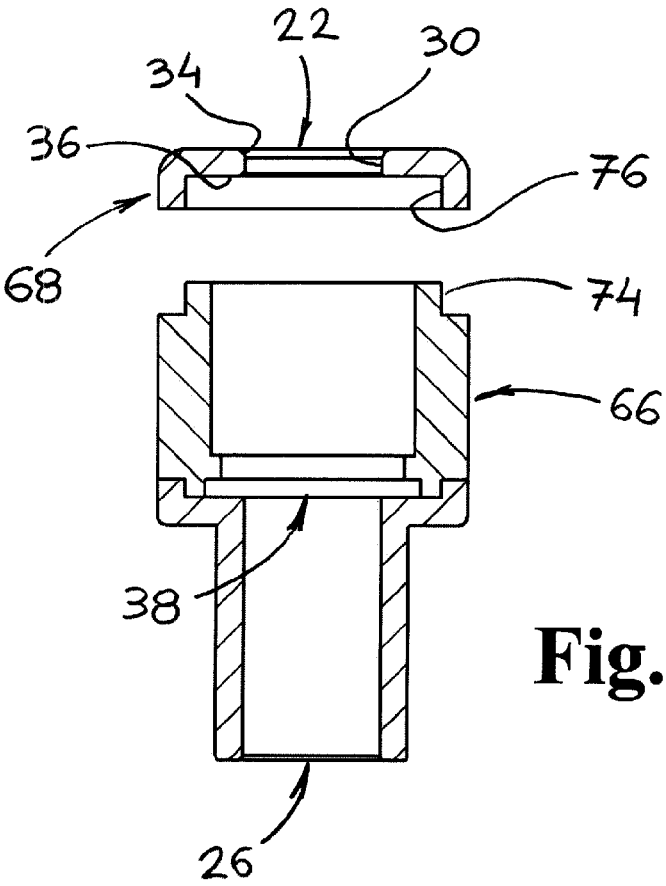
FIG. 16 is a cross sectional view of the combi adaptor of FIG. 15 with a first size adaptor head.

In order to enable the use of the balloon adaptor to both sizes of balloons, the balloon adaptor is slightly modified to a combi adaptor 66. In this case, as shown in FIGS. 15 and 16, the forward portion 24 of the balloon adaptor 10 is replaced with interchangeable size adaptor heads 68. A first size adaptor head 70 is used for inflating ball-balloons, and a second size adaptor head 72 is used for inflating modeling balloons.

In order to enable fitting between the combi adaptor 66 and the size adaptor heads 68, the combi adaptor 66 is provided with a head supporting protrusion 74, in a forward portion thereof, which fits into a corresponding protrusion receiving recess 76, in a rear portion of each of the size adaptor heads 68.

Typically, the size adaptor head is fitted on the combi adaptor 66 by one of four methods: (1) tight fitting by direct pressure, (2) snap-on fitting, (3) threading, (4) bayonet engagement. When the size adaptor head 68 is not in use, it is stored within a designated store (not shown) in the back side of a mechanical pump (when provided). Typically, modeling balloons are very difficult to inflate without the aid of mechanical means, therefore, when it is necessary to use both sizes of balloons, a mechanical pump is provided.

In order to enable the use of the balloon adaptor to both sizes of balloons, according to other embodiments, some of the balloon adaptors are provided with a size adaptor (not shown). According to one embodiment, the balloon adaptor 10 is adapted to receive a balloon flange of a modeling balloon, and the size adaptor is adapted to receive a balloon flange of a ball-balloon, which is typically larger than the flange of a modeling balloon.

Thus, when using the balloon adaptor to inflate modeling balloons, it is used as described above. When it is required to use the balloon adaptor to inflate ball-balloons, the size adaptor is fitted on the forward portion 24 of the balloon adaptor 10 by one of the four methods described above.

Although the present invention has been described to a certain degree of particularity, it should be understood that various alterations and modifications could be made without departing from the spirit or scope of the invention as hereinafter claimed.

For example, the body of the balloon adaptor does not have to be generally cylindrical and other shapes may be equally applied. However, for practical reasons, it is beneficial that the balloon insertion opening is round in order to better hold and seal the balloon flange against the balloon insertion opening.

The balloon adaptor does not have to include a one-way valve. According to some embodiments, a mechanical pump or an electrical pump having a non-return valve or other mechanical arrangement are used, and, therefore, a one-way valve within the balloon adaptor is not necessary. In these cases, the balloon adaptor is used for the benefits described above, including the ease of insertion of the balloon flange into the balloon adaptor and self retaining of the balloon to the balloon adaptor prior to inflation and during inflation.

The one-way valve does not have to be a leaf valve, and according to other embodiments of the present invention the one-way valve is formed from other kinds of check valves as known in the art, like e.g., ball check valve, diaphragm check valve, and the like.

In an un-operated position of the activating lever, the releasing lever does not have to abut against the front surface of the balloon adaptor. Furthermore, in this position, the releasing lever does not have to abut against the inflated balloon neck. This means that during the operation of the operating handle there will be a slight "idle stroke" before the releasing lever meets the inflated balloon neck and starts pressing thereon. This function is a variant during design of various applications of a balloon releasing mechanism according to the present invention.

The balloon releasing mechanism is not limited to the described above and other forms and applications may be used. In these applications, the balloon releasing mechanism may serve as a "trigger" of various toys employing a similar mechanism. For example, the balloon adaptor may be designed as a pistol or a rifle, in which the inflated balloon is "shot" forwardly due to pressing on a trigger which activates the balloon releasing mechanism.

In some applications, the balloon is inflated by the mouth of the user. In these cases, the inflating opening of the balloon adaptor is designed to fit a mouth, therefore, it does not have to be round and it may be oval or flat.

In some applications, the balloon is inflated by means of a mechanical pump. In these cases, the pump is designed as an integral part of a toy. For example, if the balloon adaptor is designed as a rifle-shaped toy, the mechanical pump is used as the loading lever of the rifle, thus adding a realization effect to the toy.

In some applications, the balloons are used in their inflated position, for example, balloon swords, in which an inflated modeling balloon is used as a sword, and the butt is used as the inflating mechanical pump. In these applications, the design of the forward portion of the balloon adaptor is slightly different than the described above since the adaptor should provide also a side support to the inflated balloon so that the "sword" remains standing straight forward.

The method of releasing the balloon from the balloon adaptor is not limited to the described above and other releasing methods are employed in other embodiments of the present invention. The four most typical methods used are: (1) squeezing sideways the balloon neck and pushing it forwardly (as described above, (2) opening or increasing the balloon insertion opening such that the balloon is self released, (3) the forward portion of the balloon adaptor is made of a flexible material, thus, when squeezing the forward portion of the balloon adaptor the balloon is released, (4) self releasing of the balloon at the end of the inflation due to "disappearing" of the balloon neck and pressing of the balloon body, i.e., the "ball" of the balloon against the forward portion of the balloon adaptor. This method, however, utilizes different type of balloons comparing to the balloons described above.

In a case when the balloon adaptor is formed to directly receive a balloon flange in a forward portion thereof, the size adaptor is not limited to receive a ball-type balloon only, and it may be adapted to receive a modeling balloon instead. In this case, the balloon adaptor will be adapted to receive a ball-balloon and not a modeling balloon.

The balloon releasing mechanism was described having a single activating lever. However, according to other embodiments, the balloon releasing mechanism comprises a multitude of activating levers, i.e., two, three, or more. This is due to the fact that a multitude of activating levers act better in pulling the balloon neck out of the balloon insertion opening since they have more friction applied, compared with the single friction point between the lever front end and the balloon neck as shown in FIG. 14.

The balloon insertion opening does not have to be formed from a cylindrical opening neck and from a conical chamfer that diverges forwardly therefrom. Alternatively, the balloon insertion opening may be formed from one conical surface that diverges forwardly and ends with a sharp rear shoulder in a rear portion thereof.

The invention claimed is:

1. A balloon adaptor (10) for receiving therein a balloon neck (16) and a balloon flange (18) of a balloon (12), in which the balloon adaptor (10) is formed from a single piece or from two pieces fitted together and said adaptor (10) comprises:

an inflating opening (26); and a balloon insertion opening (22) comprising:

a rear shoulder (32) that is formed between an opening neck (30) of the balloon insertion opening (22) wherein said rear shoulder (32) has a neck diameter (D3); and a shoulder abutment surface (36) that extends radially outwardly from the rear shoulder (32), and wherein said balloon flange (18) has an inner diameter (D1) and an outer diameter (D2), such that the inner diameter (D1) substantially equals the neck diameter (D3), and the outer diameter (D2) is larger than the neck diameter (D3).

2. The balloon adaptor (10) according to claim 1, wherein the balloon insertion opening (22) comprises a substantially cylindrical opening neck (30).

3. The balloon adaptor (10) according to claim 1, wherein: the balloon insertion opening (22) comprises a forwardly diverging conical surface.

4. The balloon adaptor (10) according to claim 1, wherein the rear shoulder (32) is sharp.

5. The balloon adaptor (10) according to claim 1, further comprising a one-way valve (38) located between the inflating opening (26) and the balloon insertion opening (22).

6. The balloon adaptor (10) according to claim 5, wherein: the one-way valve (38) is a leaf valve.

7. The balloon adaptor (10) according to claim 4, wherein: the rear shoulder (32) has a neck diameter (D3), the balloon flange (18) has a flange inner diameter (D1) and a flange outer diameter (D2), and wherein the flange inner diameter (D1) substantially equals the neck diameter (D3), and the flange outer diameter (D2) is substantially larger than the neck diameter (D3).

8. The balloon adaptor (10) according to claim 1, wherein: the inflating opening (26) is adapted to be held by a mouth of a user.

9. The balloon adaptor (10) according to claim 1, wherein: the inflating opening (26) is adapted to be connected to an inflating device.

10. The balloon adaptor (10) according to claim 1, further comprising a releasing mechanism (48), that comprises at least one activating lever (50) that is pivoted on a pivot (52) and the at least on activating lever (50) comprises an operating handle (56) and a releasing lever (58).

11. The balloon adaptor (10) according to claim 10, wherein: in an inflated position of the balloon and in an un-operated position of the at least one activating lever 50 the releasing lever (58) gently abuts against a front surface of the balloon adaptor and against the inflated balloon neck.

12. The balloon adaptor (10) according to claim 11, wherein: in a releasing stage of the inflated balloon the operating handle (56) is moved in a releasing direction (62) and a front end (64) of the releasing lever (58) presses against the balloon neck (16) in a sideways direction.

13. The balloon adaptor (10) according to claim 12, wherein: the front end (64) of the releasing lever (58) presses against the balloon neck also in a forward direction thus applying a combined sideways and forward motion on the balloon neck (16).

14. The balloon adaptor (10) according to claim 1, wherein: the adapter (10) is configured so that the releasing of the inflated balloon from the balloon adaptor (10) can be carried out in one of the following methods: (1) squeezing sideways the balloon neck and pushing it forwardly, (2) opening or increasing a balloon insertion opening, (3) forming a forward portion of the balloon adaptor from a flexible material that may be squeezed to release the balloon, (4) self releasing the balloon at the end of inflation due to disappearing of a balloon neck and pressing by the balloon body against a forward portion of the balloon adaptor.

15. The balloon adaptor (10) according to claim 1, wherein: the adaptor (10) further comprises a combi adaptor (66) having a forward portion that comprises a head supporting protrusion (74) that is adapted to fit into a corresponding protrusion receiving recess (76) in a rear portion of each of the size adaptor heads.

* * * * *